US006058628A

United States Patent [19]

Theurer et al.

[11] Patent Number: 6,058,628

[45] Date of Patent: May 9, 2000

[54] SYSTEM FOR DISTRIBUTING BALLAST IN A TRACK BED

[75] Inventors: Josef Theurer, Vienna; Bernhard Lichtberger, Leonding, both of Austria

[73] Assignee: Franz Plasser Bahnbaumaschinen - Industriegesellschaft m.b.H., Vienna, Austria

[21] Appl. No.: 09/175,281

[22] Filed: Oct. 20, 1998

[30] Foreign Application Priority Data

Nov. 5, 1997 [AT] Austria ..... 1873/97

[51] Int. Cl.[7] ..... E02F 5/22

[52] U.S. Cl. ..... 37/105; 171/16; 104/2

[58] Field of Search ..... 37/104, 105; 104/2; 171/16

[56] References Cited

U.S. PATENT DOCUMENTS 3,705,772 12/1972 Andreas .
4,179,216 12/1979 Theurer et al. .
4,249,325 2/1981 Theurer .
4,497,256 2/1985 Hansmann et al. ..... 104/11
4,986,189 1/1991 Theurer et al. .
5,094,018 3/1992 Theurer et al. .

FOREIGN PATENT DOCUMENTS 0 487 465 5/1992 European Pat. Off. .

*Primary Examiner*—H. Shackelford
*Attorney, Agent, or Firm*—Collard & Roe, P.C.

[57] ABSTRACT

A machine for distributing ballast in a track bed comprises a machine frame supported on the track by undercarriages for mobility in an operating direction, a ballast plow adjustably mounted on the machine frame for distributing the ballast in the track bed, drives for adjusting the ballast plow relative to the machine frame, a contactless sensor arranged ahead of the ballast plow in the operating direction for detecting an existing track bed profile extending perpendicularly to the longitudinal direction, a position indicator for indicating a change in the position of the ballast plow relative to the machine frame, and a control for the drives comprising a memory storing a desired track bed profile.

8 Claims, 2 Drawing Sheets

SYSTEM FOR DISTRIBUTING BALLAST IN A TRACK BED

BACKGROUND OF THE INVENTION

1. Field of the Invention

The present invention relates to a machine for distributing ballast in a track bed, which comprises a machine frame extending in a longitudinal direction and supported on the track by undercarriages for mobility in an operating direction, a ballast plow adjustably mounted on the machine frame for distributing the ballast in the track bed, drive means for adjusting the ballast plow relative to the machine frame, and a control for the drive means. It is also directed to a method for distributing ballast in the track bed.

2. Description of the Prior Art

A machine of this type has been described, for example, in U.S. Pat. No. 5,094,018, and comprises a ballast plow which includes a center plowshare positioned above the track ties and shoulder plowshares in the area of the track shoulders and extending laterally from the center plowshare. Such ballast planing machines are used to provide properly ballasted track beds meeting regulations. If any track section requires additional ballast for proper ballasting, such additional ballast is conveyed thereto from a ballast storage bin.

U.S. Pat. No. 4,986,189 discloses a track tamper whose track tamping tools may be laterally pivoted out of the way of obstacles, particularly in track switches. A plurality of sensors are arranged in a transverse row ahead of the tamper, and this sensing arrangement controls the drives for vertically adjusting and laterally pivoting the tamping tools. When the sensing arrangement detects an obstacle, the drives are actuated to move a respective tamping tool out of the way of the obstacle. In this way, all the other tamping tools of the tamping head may continue to be operated to tamp the ballast while the tamping tool or tamping tools encountering the obstacle have been moved out of the way. Suitable position indicators register the prevailing positions of the tamping tools.

U.S. Pat. Nos. 3,705,772 and 4,179,216, as well as EP 0 487 465 A1 disclose machines running on a track for sensing the boundary of a space surrounding the track.

SUMMARY OF THE INVENTION

It is the primary object of this invention to provide a machine and method of the first-indicated type which makes it possible to obtain a more uniform distribution of the ballast in the ballast bed.

The above and other objects are accomplished with such a machine according to the invention with a contactless sensor arranged ahead of the ballast plow in the operating direction for detecting an existing track bed profile extending perpendicularly to the longitudinal direction, a position indicator for indicating a change in the position of the ballast plow relative to the machine frame, and a control for the drive means comprising a memory storing a desired track bed profile, the sensor and the position indicator being connected to the control.

The ballast distributing method of the present invention comprises the steps of contactlessly sensing the track bed profile immediately before the ballast is distributed by the ballast plow, continuously comparing the sensed track bed profile with a predetermined desired track bed profile, and controlling the ballast plow position in dependence on any difference between the sensed and desired track bed profiles.

Such a control for adjusting the ballast plow makes it possible for the first time to record the ballast condition immediately before the ballast plow is operated and to adjust the ballasting of the track bed according to the detection of track sections which may either have a lack of sufficient ballast or an excess thereof. The position indicator enables the machine operator to record the position of the ballast plow relative to the ballast bed profile as well as the desired ballast bed profile, for example on a monitor, and to adjust this ballast plow position accordingly. Such an adjustment is preferably made by means of a computer program.

BRIEF DESCRIPTION OF THE DRAWING

The above and other objects, features and advantages of this invention will become more apparent from the following detailed description of a now preferred embodiment thereof, taken in conjunction with the accompanying drawing wherein.

DETAILED DESCRIPTION OF THE PREFERRED EMBODIMENT

Figure 1:
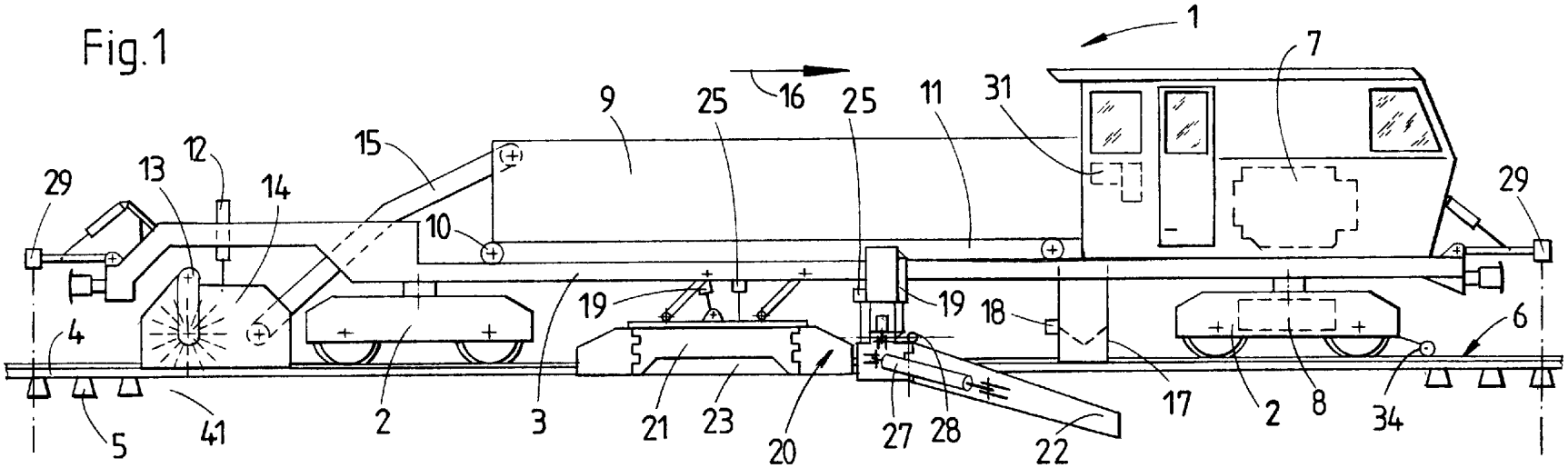
FIG. 1 is a side elevational view of a ballast distributing machine.

As shown in FIG. 1, machine 1 for distributing ballast in a track bed, also known as a ballast plow, comprises machine frame 3 extending in a longitudinal direction and supported on track 6 by undercarriages 2 for mobility in an operating direction indicated by arrow 16. The track bed is comprised of track bed portion 41 supporting track 6 and shoulders 26. The track is comprised of rails 4 fastened to ties 5, and power plant 7 serves to operate drive 8 for moving the machine frame in the operating direction, as well as the other operating drives of machine 1.

Ballast plow 20 is adjustably mounted on machine frame 3 between undercarriages 2 for distributing the ballast in the track bed, and drives 19 for adjusting the ballast plow relative to the machine frame connect the ballast plow to the machine frame. Ballast storage silo 9 is mounted on machine frame 3 and comprises, instead of a fixed bottom, a bottom conveyor band 11 movable by drive 10 in the longitudinal direction. Furthermore, ballast broom 14 rotatable by drive 13 and vertically adjustable by drive 12 is mounted on machine frame 3 at a rear end of machine 1, as seen in the operating direction. In this way, any excess ballast may be swept off the track and returned to ballast storage silo 9 by conveyor band 15. At the front end of the ballast storage silo, as seen in the operating direction, an outlet chute 17 is associated with each rail 4 to lead from the ballast storage silo to the associated rail. The amount of ballast discharged through the openings of the outlet chutes is controlled by closures adjusted by drives 18.

Figure 2:
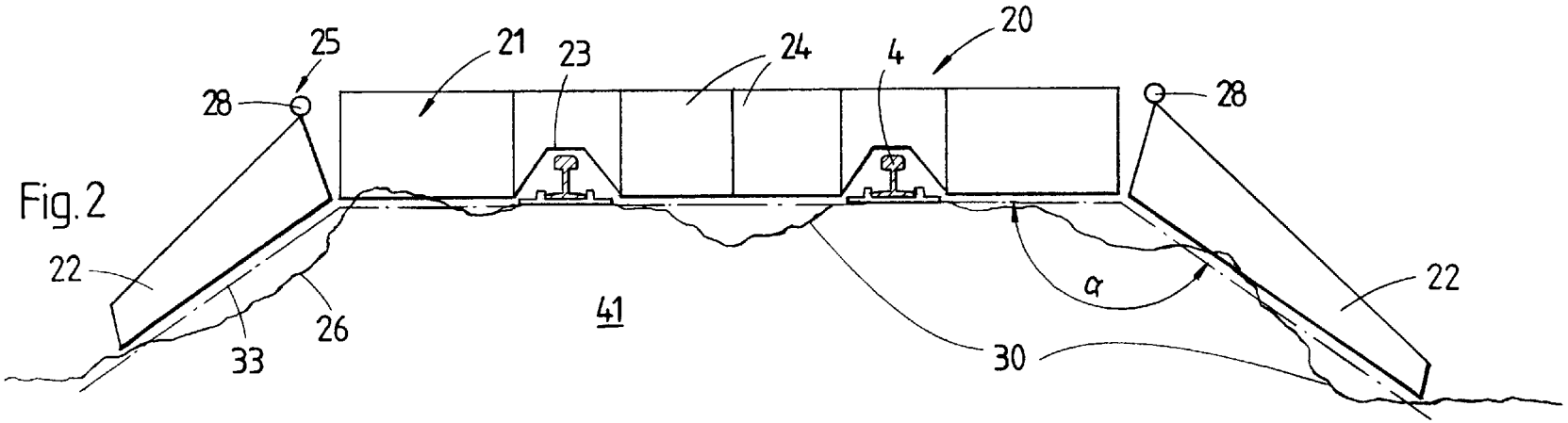
FIG. 2 is a schematic end view of the ballast plow indicating the existing ballast bed profile in full lines and the desired ballast bed profile in phantom lines.

As best shown in FIG. 2, ballast plow 20 comprises center plowshare 21 extending transversely to the longitudinal direction and shoulder plowshares 22 extending from respective ends of the center plowshare. Center plowshare defines two tunnels 23 covering rails 4 and is designed to create a smooth track bed under ties 5. The portion of center plowshare 21 between rails 4 is comprised of four ballast guide blades 24 forming an X, and these ballast guide blades are vertically adjustable independently of each other, as has been disclosed in U.S. Pat. No. 4,249,325, to enable the ballast flow produced by the guide blades to be adjusted.

Drives 27 connected to shoulder plowshares 22 serve to adjust angle a between the center and shoulder plowshares so that the angular position of the shoulder plowshares relative to shoulders 26 may be varied. Position indicator 25, which forms part of the control of the ballast plow drives, comprises angle measuring device 28 for detecting the angles of inclination of the shoulder plowshares.

Figure 3:
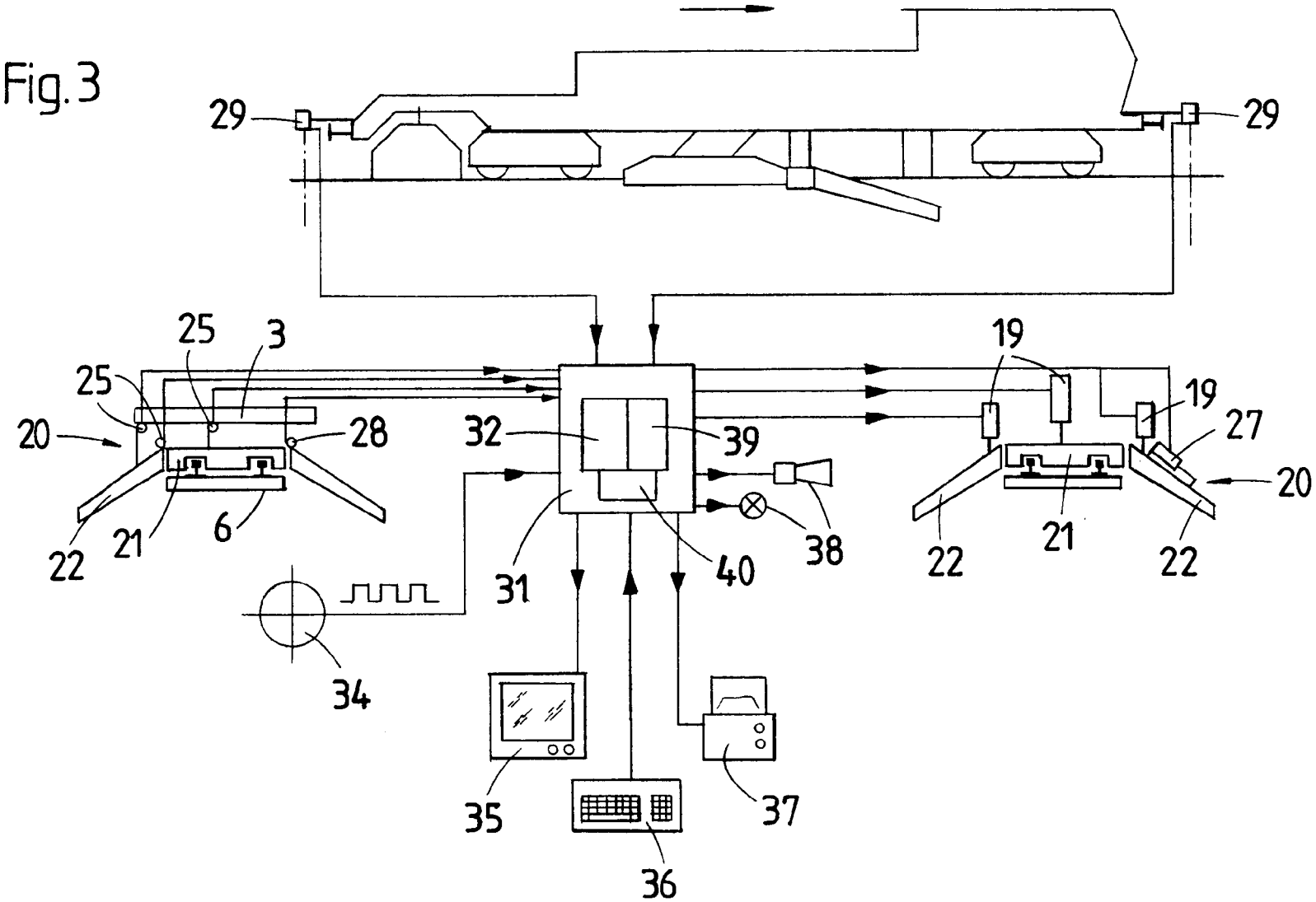
FIG. 3 is a simplified circuit diagram showing the control of the invention.

According to the invention, contactless sensor 29 is arranged ahead of ballast plow 20 in the operating direction for detecting an existing track bed profile extending perpendicularly to the longitudinal direction (see full line 30 in FIG. 2). In the illustrated embodiment, a second contactless sensor 29 is arranged behind the ballast plow in the operating direction for detecting an existing track bed profile extending perpendicularly to the longitudinal direction. As shown in FIG. 3, control 31 for the ballast plow position adjustment drives comprises memory 32 for storing a desired track bed profile (see phantom line 33 in FIG. 2), a differential circuit unit 39 for detecting any deviation of the existing track bed profile detected by the second contactless sensor from the desired track bed profile, and computer program 40.

Contactless or proximity sensors 29 may be laser scanners which sense the environment in two dimensions, and which operate according to the principle of measuring the duration of the impulses. For this purpose, laser beam impulses are emitted. When a laser impulse impinges upon an object, for example a ballast stone, it is reflected and recorded in the receiver of sensor 29. The duration between the emission of the laser beam and the reception of the reflected beam is directly proportional to the distance between the sensor and the object. An internal rotary mirror deflects the intermittent laser beam and, in this way, the environment is sensed in the form of a fan. The contour of the objects is computed from the sequence of the received impulses. The measured data are available in real time.

As shown in FIG. 3, sensors 29 and position indicators 25 for indicating a change in the position of the ballast plow relative to the machine frame are connected to control 31. Also connected thereto are monitor 35 indicating the existing track bed profile detected by front contactless sensor 29 (full line 30 in FIG. 2), the desired track bed profile stored in memory 32, and the position of ballast plow 20 indicated by position indicators 25, and odometer 34. Differential circuit unit 39 detects any deficiency or excess of ballast mirroring a difference between the existing and the desired track bed profile. Keyboard 36, printer 37 and an optical and/or acoustic warning device 38 are also connected to the control. Computer program 40 serves to determine an optimal position of the ballast plow in relation to the detected ballast deficiency or excess so that the ballast plowshares may be adjusted accordingly.

In the operation of machine 1, ballast is distributed in the track bed by adjustably positionable ballast plow 20 by contactlessly sensing the track bed profile by front sensor 29 immediately before the ballast is distributed by the ballast plow. The sensed data are temporarily stored in a shift register. As soon as odometer 34 has emitted a number of impulses corresponding to the distance between front sensor 29 and ballast plow 20, the temporarily stored sensed data reflecting the existing track bed profile (full line 30) is transmitted to monitor 35. There, the sensed track bed profile (full line 30) is continuously compared with a predetermined desired track bed profile (phantom line 33), the upper running faces of rails 4 serving as a common reference point. At the same time, monitor 35 records the actual position of center plowshare 21 and shoulder plowshares 22 relative to the track bed, as indicated by position indicators 25. The ballast plow position is then controlled in dependence on any difference between the sensed and desired track bed profiles. This control may be effected manually by a machine operator to obtain an optimally uniform ballast distribution by vertically adjusting ballast plow 20, and/or angularly adjusting shoulder plowshares 22, and/or suitably positioning guide blades 24 on the basis of the visually recognizable differences between the sensed and desired track bed profiles (full line 30 and phantom line 33). Alternatively, the control is automated by computer program 40.

Preferably, the track bed profile immediately after the ballast has been distributed by the ballast plow is also contactlessly sensed at rear sensor 29, and the sensed track bed profile is compared with the predetermined desired track bed profile.

For example, if differential circuit unit 39 in control 31 indicates an excess of ballast on the right track shoulder during the operation of machine 1, shoulder plowshares 22 and ballast guide blades 24 of center plowshare 21 will be automatically driven into positions causing the flow of ballast to be directed from the right to the left shoulder. By measuring the distance machine 1 advances with odometer 34, any deficiency or excess of ballast may be computed continuously. For this purpose, the difference between existing track bed profile 30 and desired track bed profile 33 computed by differential circuit unit 39 is multiplied by the measured distance machine 1 has advanced. If this indicates that a set limit of ballast deficiency has been surpassed, drive 18 for the adjustable closure of outlet chute 17 is actuated to permit ballast to be discharged from ballast storage silo 9 through the opening of the outlet chute. This enables additional ballast to be delivered to the right and/or left shoulder, when needed.

Since the existing track bed profile is recorded ahead of ballast plow 20, any obstacles, such as masts supporting overhead wires, track switch control devices, current-carrying rails, etc., will also be recorded, which makes it possible to raise parts of the ballast plow and/or ballast broom 14 automatically to avoid such obstacles.

Rear sensor 29 enables the track bed profile produced by ballast plow 20 to be recorded, and to compare this track bed profile with the desired track bed profile stored in memory 32. The result may be documented by printing it on printer 37. This makes it possible to obtain a balance of ballast deficiency or excess.

What is claimed is:

1. A machine for distributing ballast in a track bed, which comprises (a) a machine frame extending in a longitudinal direction and supported on the track by undercarriages for mobility in an operating direction, (b) a ballast plow adjustably mounted on the machine frame for distributing the ballast in the track bed, (c) drive means for adjusting the ballast plow relative to the machine frame, (d) a contactless sensor arranged ahead of the ballast plow in the operating direction for detecting an existing track bed profile extending perpendicularly to the longitudinal direction, (e) a position indicator for indicating a change in the position of the ballast plow relative to the machine frame, and (f) a control for the drive means comprising (1) a memory storing a desired track bed profile, and (2) the sensor and the position indicator being connected to the control.

2. The ballast distributing machine of claim 1, wherein the control further comprises a monitor indicating the existing track bed profile detected by the contactless sensor, the desired track bed profile stored in the memory, and the position of the ballast plow indicated by the position indicator.

3. The ballast distributing machine of claim 1, further comprising an odometer connected to the control, and wherein the control further comprises a differential circuit unit for detecting a deficiency or excess of ballast mirroring a difference between the existing and the desired track bed profile, and a computer program determining an optimal position of the ballast plow in relation to the detected ballast deficiency or excess.

4. The ballast distributing machine of claim 3, further comprising a ballast storage silo having a controllable outlet opening, and means for controlling the outlet opening for discharging an amount of ballast from the storage silo dependent on the detected ballast deficiency or excess.

5. The ballast distributing machine of claim 1, wherein the ballast plow comprises a center plowshare extending transversely to the longitudinal direction and shoulder plow shares extending from respective ends of the center plowshare, and the position indicator comprises an angle measuring device for detecting the angles of inclination of the shoulder plowshares.

6. The ballast distributing machine of claim 1, comprising a second contactless sensor arranged behind the ballast plow in the operating direction for detecting an existing track bed profile extending perpendicularly to the longitudinal direction, and a differential circuit unit for detecting any deviation of the existing track bed profile detected by the second contactless sensor from the desired track bed profile.

7. A method of distributing ballast in a track bed by an adjustably positionable ballast plow, comprising the steps of (a) contactlessly sensing the track bed profile immediately before the ballast is distributed by the ballast plow, (b) continuously comparing the sensed track bed profile with a predetermined desired track bed profile, and (c) controlling the ballast plow position in dependence on any difference between the sensed and desired track bed profiles.

8. The ballast distributing method of claim 7, comprising the further steps of contactlessly sensing the track bed profile immediately after the ballast has been distributed by the ballast plow, and the sensed track bed profile is compared with the predetermined desired track bed profile.

* * * * *